US006660138B2

(12) United States Patent
Lin et al.

(10) Patent No.: US 6,660,138 B2
(45) Date of Patent: Dec. 9, 2003

(54) ELECTROPOLISHING PROCESS MEANS FOR AN INNER SURFACE OF A LONG TUBE

(75) Inventors: Chun-Hung Lin, I-Lan (TW); Chen-Der Tsai, Hsinchu (TW); Yun-Sheng Chung, Hsinchu (TW); Chin-Ching Wu, Hsinchu (TW); Yuh-Feng Chen, TaiNan (TW); Hann-Tsong Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/076,289

(22) Filed: Feb. 19, 2002

(65) Prior Publication Data

US 2003/0098245 A1 May 29, 2003

(30) Foreign Application Priority Data

Nov. 28, 2001 (TW) ..... 90220569 U

(51) Int. Cl.[7] ..... B23H 11/00; C25B 9/00; C25C 7/00; C25D 17/00; C25F 7/00

(52) U.S. Cl. ..... 204/275.1; 205/652; 205/653; 205/670; 205/672

(58) Field of Search ..... 205/652, 653, 205/670, 672, 673, 686, 640; 204/275.1

(56) References Cited

U.S. PATENT DOCUMENTS 4,690,737 A * 9/1987 Vishnitsky ..... 205/670
4,733,054 A * 3/1988 Paul ..... 392/418
4,772,367 A * 9/1988 Menzel et al. ..... 205/653
5,958,195 A * 9/1999 Lorincz et al. ..... 204/224 M

* cited by examiner

*Primary Examiner*—Roy King
*Assistant Examiner*—Wesley A. Nicolas
(74) *Attorney, Agent, or Firm*—Troxell Law Office PLLC

(57) ABSTRACT

The present invention is an electropolishing process and device for electropolishing an inner surface of a long tube, especially applied to a long tube of greater than two meters and a diameter range between 0.3 and 5 cm. Wherein, the present invention comprises at least one tube, and one complex electrode. An inner surface of the tube is for electropolishing process, and it is an anode as well. The electrode is a cathode and placed on a center of a partition. An end of electrode connects to a cable, the cable is driven by an axial mechanism to be moved the electrode toward the axial mechanism itself. Inside of the tube is full o electrolyte, which is an electrifying medium to connect both anode and cathode. Further, electrolyte cooperates with the electrode to perform the electropolishing process on the inner surface of tube.

14 Claims, 6 Drawing Sheets

ELECTROPOLISHING PROCESS MEANS FOR AN INNER SURFACE OF A LONG TUBE

1. FIELD OF THE INVENTION

The present invention is an electropolishing process and device for electropolishing an inner surface of a long tube, especially applied to a long tube having a length greater than two meters and an inside diameter having a range between 0.3 to 5 cm.

2. BACKGROUND OF THE INVENTION

A process of electropolishing includes connecting a workpiece to an anode and a metal to a cathode. Aforesaid structure of the workpiece connected to the anode and the metal connected to the cathode is put into an electrolyte for electrifying with a direct current to remove the defects on the workpiece surface and make the surface shiny and smooth. Electropolishing improves surface cleanness, roughness, passivation, etc. For different fields of semiconductor, chemical industry, biochemical engineering, food industry, tubes are needed to deliver fluids of those fields. Inner surfaces of tubes are treated by polishing or electrolysis to approach high cleanness and anti-corrosion. Especially, products of IC/LCD/III-V require high standards of cleanness and anti-corrosion, thus, applying the present invention to the products is a challenge.

U.S. Pat. Nos. 4,826,582 and 4,849,084 used part of the technologies of electropolishing a 10-meter heat exchange tube. The electrode device for positioning the workpiece and sealing the electrolyte is required. The prior art adopts a 3-layer structure of delivering electrolyte of high pressure air, but unfortunately the structure is very complicated and only suitable for the larger diameter workpieces, not for the tube of inside diameter under 3 cm.

In U.S. Pat. No. 5,958,195, which taught the technology of electropolishing an inner surface of a long and bended tube. However, to electropolish a bended tube, electrode must move alone a bended curve so as to not cause a short circuit. The most important parts are a flexible electrode and an insulation device. The insulation device avoids short circuit and non-concentricity, but this kind of device blocks a flow of electrolyte and makes a non-uniform electric field.

U.S. Pat. Nos. 4,601,802 and 4,705,611 offers a fixture applied an inside tube, and the fixture stabilizes a plurality of axially rotating tubes simultaneously. An end connector can circulate tube and exhaust gas from an upper end, and electrolyte can be recycled after overflowing. An electrode length is equal to the tube length, therefore a huge space and a super power supplier are needed to fit such conditions.

Based on the aforesaid issues, the present inventor of the patent has being studied and referred to practical experiences and theory for designing and effectively improving the prior arts.

SUMMARY OF THE INVENTION

The first object is to offer an electropolishing process and device for electropolishing an inner surface of a long tube, which improves an electrode design and applies theories of macro and micro polishing to an electrode for improving a manufacturing rate for both smoothing and passivation effect on the surface of workpiece.

The second object is to offer an electropolishing process and device for electropolishing an inner surface of a long tube, which can treat an inner surface of a tube greater than 2 meters and an inside diameter range of 0.3 to 5 cm. The device is simple to reduce equipment costs.

The third object is to offer an electropolishing process and device for an inner surface of a long tube, which avoids short circuiting and non-concentricity problems. An electrode of the present invention is installed through a center of a partition, so the electrode has a certain distance with the inner surface in tube because the partition supports the electrode. Therefore, the short circuit and non-concentricity are solved. Further the average electric field is kept all the time because the partition is round.

The fourth object is to offer an electropolishing process and device for electropolishing an inner surface of a long tube, which electrode can be designed to have multiple sections. Thereby, eliminating the need for a huge storage space. Further, the electrode can be added to different sections depending on needs to improve electrolyzing and polishing result.

The appended drawings will provide further illustration of the present invention, together with description; serve to explain the principles of the invention.

DETAILED DESCRIPTION OF THE PREFERRED EMBODIMENTS

For different fields of semiconductor, pharmaceutical industry chemical industry, biochemical engineering, food industry, inner surfaces of needed tubes and fitting of aforesaid fields are treated by electropolishing process for improving surface cleanness, roughness and passivation results. The present invention comprises an electrolyte delivering system, which makes electrolyte uniformly pass through an inner surface of a long tube. A cable guides a direct current to a working area of an inner surface of tube, and the electrolyte is an electrifying media to make a complete electric path. An end of the cable can be added to an insulated electrode means, which slowly moves along an imaginary central axis of the tube such that a cathode electrode does not contact an anode electrode, thus short circuit problem is then evaded. The electrode means is complex to produce a huge and fine polishing result, such as a Cu-W bar.

Figure 1:
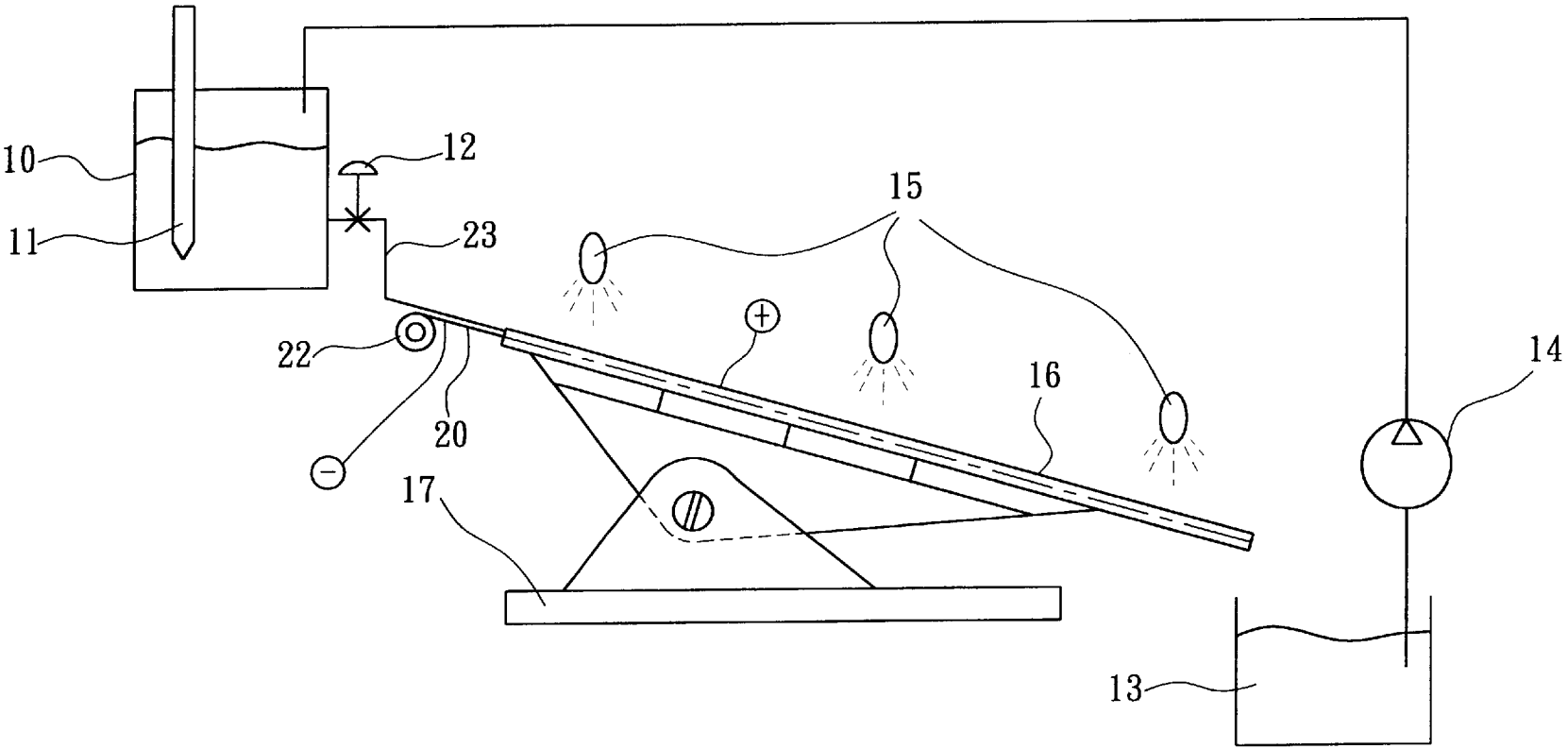
FIG. 1 is a schematic of a practical application of the present invention.

Referring to FIG. 1, which is a schematic of a practical application of the present invention. Electrolyte is stored in a tank 10, and a heater 11 is inside the tank 10 for keeping the electrolyte at a predetermined temperature. Electrolyte passes through a switch 12 and a pipe 23 to a tube 16. The switch 12 is made of TEFLON or other heat-resistant and acid-proof material. The tube 16 is placed on an inclined platform 17, and thus a higher end of tube 16 connects to the pipe 23 for passing electrolyte from higher end to a lower end. Inclined angles of the inclined platform 17 can be adjusted to control electrolyte flowing speeds. Tube 16 includes at least one electrode (not shown in FIG. 1), which is hung up by a cable 20, and another end of the cable 20 is rolled up by an axial mechanism 22. The axial mechanism 22 rolls up cable 20 to move the electrode upward when electropolishing process reaction is being performed inside tube 16. The present invention adopts that electron exchanging from an anode half reaction and a cathode half reaction generates an electropolishing process result. Tube 16 is an anode, thus an inner surface of tube 16 is an anode, and anode loses electrons. The electrode is a cathode, and the cathode receives electrons. FIG. 1 does not show the electrode, so only cable 20 is shown to represent the electrode. Tube 16 is about 2 meters long or more. The electrolyte temperature is lower when electrolyte approaching to a lowest end of tube 16, thus a plurality of halogen bulbs 15 are placed around tube 16 for heating. Electrolyte is recycled after passing through tube 16 to a recycling tank 13, then it is delivered back to tank 10 by a pump 14 which is heat-resistant and acid-proof. The aforesaid explains a complete procedure for electropolishing process. Following is a detail description.

Figure 2:
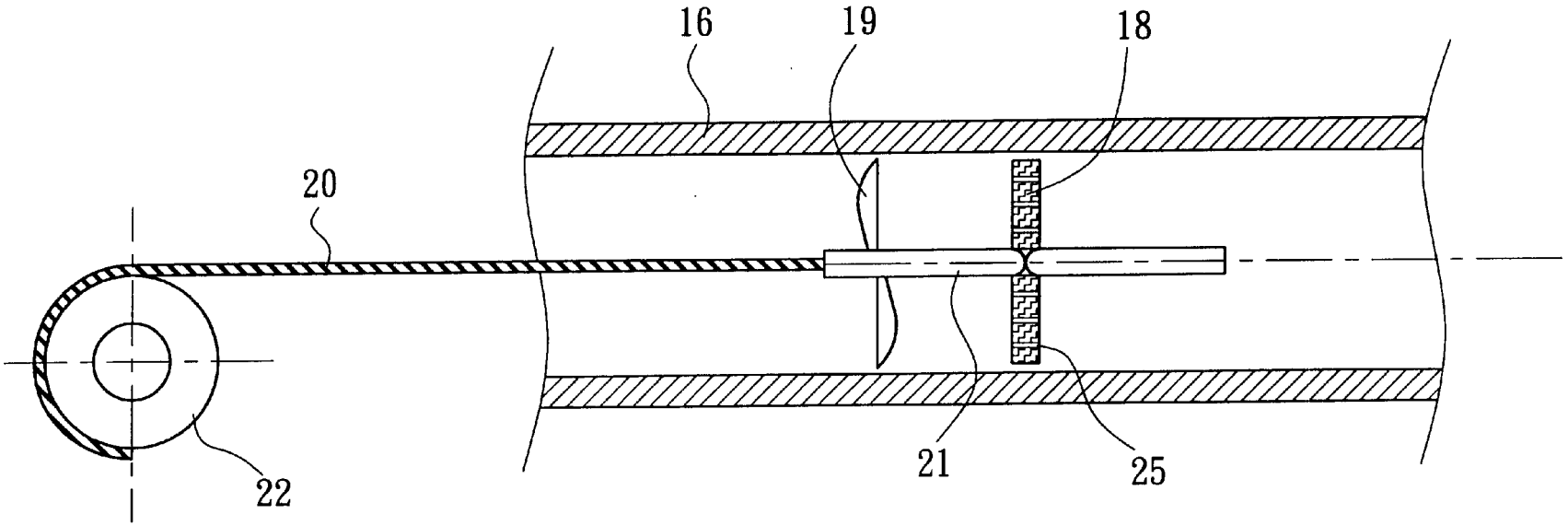
FIG. 2 is a first preferred embodiment of the present invention.
Figure 5:
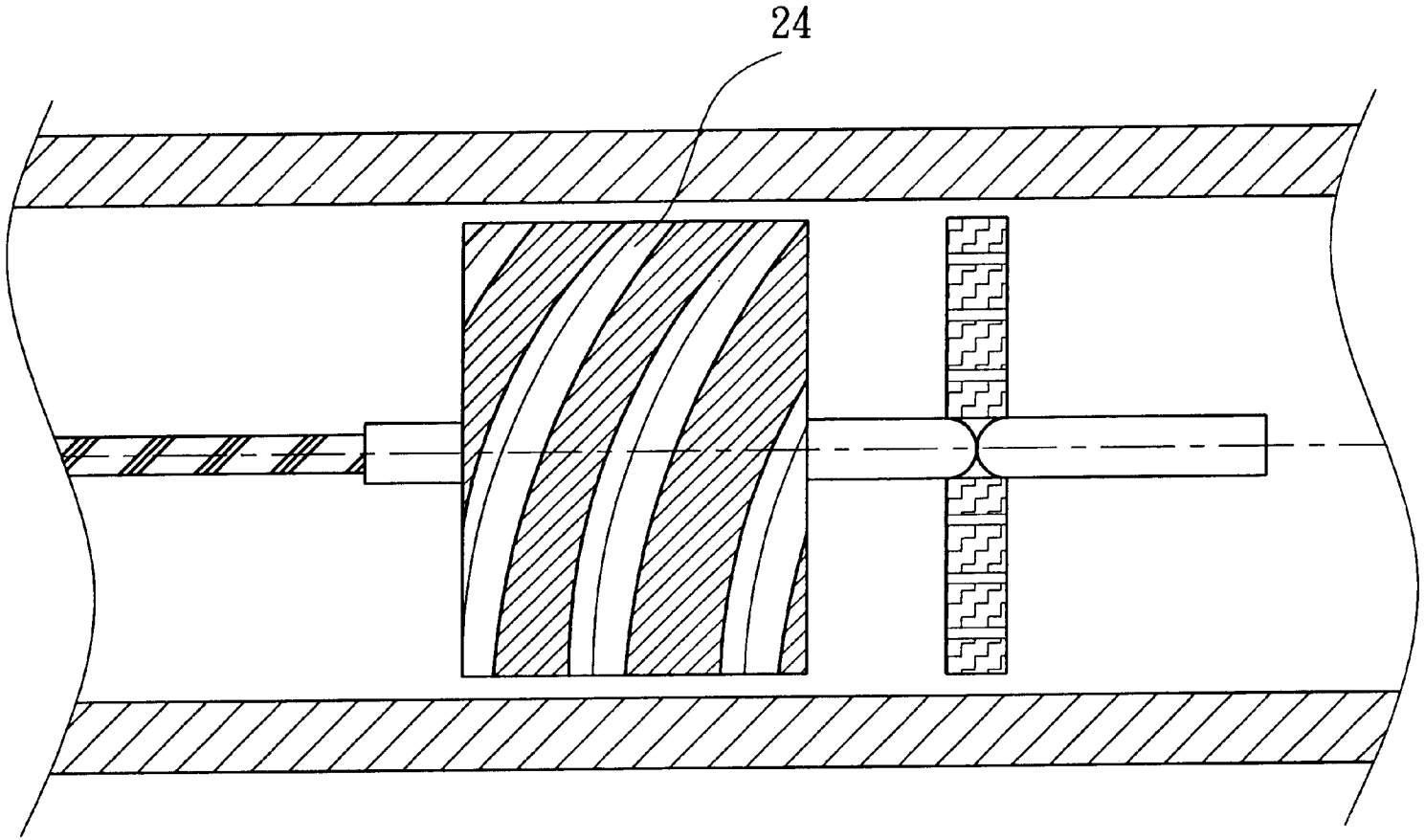
FIG. 5 is a third preferred embodiment of the present invention.
Figure 6:
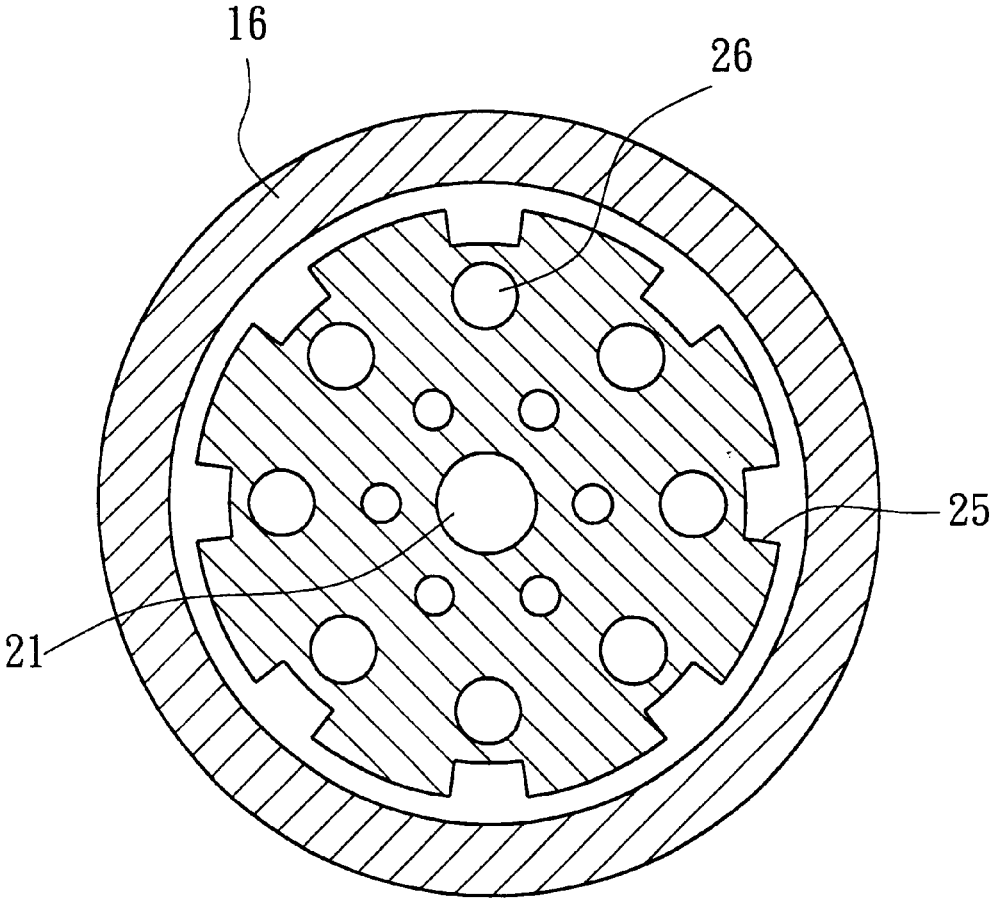
FIG. 6 is a sectional view of a partition of the present invention.

Referring to FIG. 2, which is a first preferred embodiment of the present invention. In the embodiment, at least one partition 18, a complex electrode 21 and a propeller 19 are in a tube 16; the electrode 21 is hung up by the cable 20 and driven by the axial mechanism 22 to move toward the axial mechanism 22. Electrolyte fills an inner diameter of the tube 16, and a diameter of the partition 18 is slightly smaller than an inner diameter of the tube 16 (a diameter range of electropolishing process of the present invention is between 0.3 to 5 cm). The partition 18 floats in the tube 16 and is almost perpendicular to the inner surface of tube 16, so the partition 18 does not touch the inner surface of the tube 16. Finally, the cable 20 provides a direct electric current to the electrode 21 and through a medium of the electrolyte to the inner surface; the electropolishing process reaction is then started. The electrode 21 is placed in a center of the partition 18, and it is double electrodes, which is complex for approaching a huge and fine polishing result. Further, the electrode 21 can be made from different materials, such as copper, wolfram, stainless steel, etc. On the other hand, the electrode 21 can be single as well (not shown in figure), and the single electrode is positioned between partition 18 and the propeller 19. The reaction is preceded only between them, so electropolishing process goes slowly. The propeller 19 quickly exhausts air bulbs generated by the reaction, because air bulbs affect polished surface. When electrolyte flowing from an end close to axial mechanism 22 to another end of tube 16, propeller 19 is also driven by axial mechanism 22 in an opposite direction. The propeller generates a vortex by the aforesaid relative motion. Air bulbs in between partition 18 and the propeller 19 and another side of partition 18 are exhausted fast. Referring to FIG. 5, which is a third preferred embodiment of the present invention. Propeller 19 can be replaced with a screw slideway 24, and air bulbs go through the screw slideway 24 to an outside. Obviously, the screw slideway 24 functions as propeller 19. As shown in FIG. 2, plural slots 25 are designed on an outer edge of partition 18, those slots 25 make electrolyte flow close to inner surface more fluently and a boundary layer is then broken to generate an average anode membrane, such flow effectively brings air bulbs out. Referring to FIG. 6, which is a sectional view of a partition of the present invention. For fluently introducing electrolyte, partition 18 has many holes 26 as meshes. Further, the partition 18 is made of TEFLON or other insulating material for saving total energy and enhancing the electropolishing process result. Another function of partition 18 is to avoid contacting the negative electrode and positive inner surface, hence short circuit and non-concentricity are solved. Further, the average electric field is kept all the time because partition 18 is round. Partition 18 is variable for different tube diameters.

Figure 3:
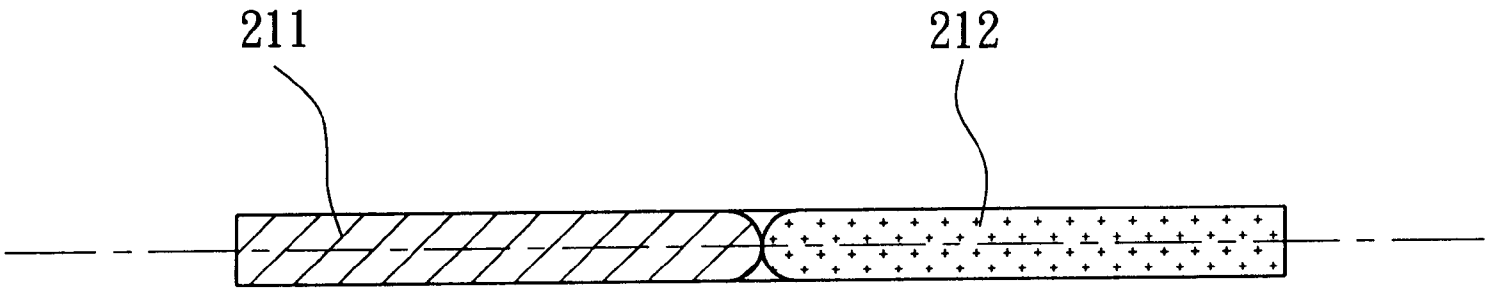
FIG. 3 is a preferred embodiment of an electrode of the present invention.

Referring to FIG. 3, which is a preferred embodiment of an electrode of the present invention. The electrode can be made of plural materials for different levels of polishing. A complex electrode 21 consists of a first electrode 211 and a second electrode 212 for two-stage electropolishing process reaction, and it is to promote result shown as in FIG. 1.

Figure 4:
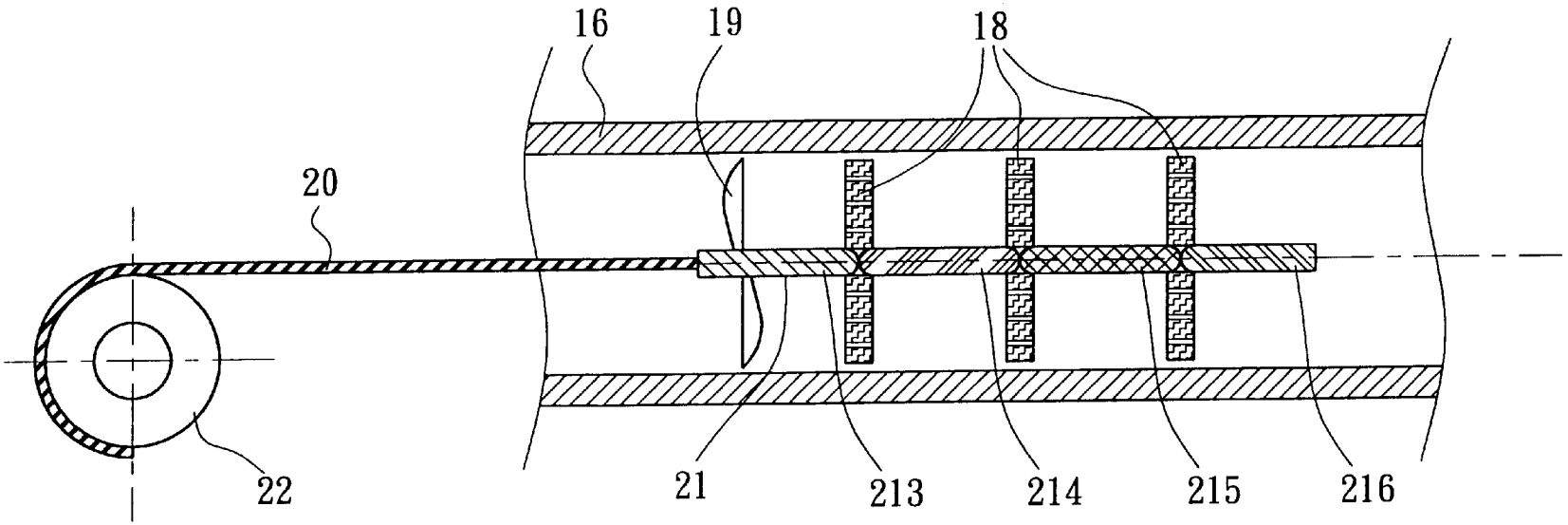
FIG. 4 is a second preferred embodiment of the present invention.

Referring to FIG. 4, which is a second preferred embodiment of the present invention. An electrode 21 of the preferred embodiment includes a third electrode 213, a fourth electrode 214, a fifth electrode 215 and a sixth electrode 216. The electrodes are placed in a center of a plurality of partitions 18. This embodiment is for multi-stage reaction, and it seems each kind of electropolishing processing reaction can be approached from the embodiment.

While the present invention has been shown and described with reference to preferred embodiments thereof, and in terms of the illustrative drawings, it should be not considered as limited thereby. Thus, the present invention is infinitely used. However, various possible modification, omission, and alterations could be conceived of by one skilled in the art to the form and the content of any particular embodiment, without departing from the scope and the spirit of the present invention.

The invention is disclosed and is intended to be limited only the scope of the appended claims and its equivalent area.

What is claimed is:

1. An electropolishing device for electropolishing an inner surface of a tube comprising:

a) a complex electrode having at least one electrode;

b) at least one disc-shaped partition, each partition having a plurality of slots on an outer circumference and a plurality of mesh holes, the complex electrode being connected to a center of the at least one partition;

c) a screw structure being connected to the complex electrode;

d) a cable connected to the complex electrode at a first end, the cable providing a direct current to the complex electrode; and e) an axle mechanism connected to a second end of the cable such that the axle mechanism moves the electrode through the tube in a direction opposite to a flow of an electrolyte to electropolish the inner surface of the tube.

2. The electropolishing device for electropolishing the inner surface of the tube according to claim 1, further comprising: a heater heating the electrolyte to a preselected temperature before the electrolyte flows into the tube.

3. The electropolishing device for electropolishing the inner surface of the tube according to claim 1, further comprising: a plurality of halogen bulbs positioned adjacent to an exterior of the tube to control the temperature of the electrolyte in the tube.

4. The electropolishing device for electropolishing the inner surface of the tube according to claim 1, wherein the electrode is made of a material selected from the group consisting of copper, wolfram, and stainless steel.

5. The electropolishing device for electropolishing the inner surface of the tube according to claim 1, wherein the tube comprises an anode.

6. The electropolishing device for electropolishing the inner surface of the tube according to claim 1, wherein the electrode comprises a cathode.

7. The electropolishing device for electropolishing the inner surface of the tube according to claim 1, wherein the partition is made of an insulating material.

8. The electropolishing device for electropolishing the inner surface of the tube according to claim 1, wherein the screw structure is selected from the group consisting of a propeller and a screw slideway.

9. The electropolishing device for electropolishing the inner surface of the tube according to claim 1, wherein the tube has a diameter between 0.3 and 5.0 centimeters.

10. The electropolishing device for electropolishing the inner surface of the tube according to claim 1, wherein the tube has a length of at least 2 meters.

11. The electropolishing device for electropolishing the inner surface of the tube according to claim 1, further comprising a pump for recycling the electrolyte.

12. The electropolishing device for electropolishing the inner surface of the tube according to claim 1, wherein the tube is inclined such that a high end of the tube is positioned below a first tank and a low end of the tube is positioned above a recycling tank.

13. The electropolishing device for electropolishing the inner surface of the tube according to claim 1, wherein the at least one electrode comprises two electrodes.

14. The electropolishing device for electropolishing the inner surface of the tube according to claim 1, wherein the at least one electrode comprises four electrodes, and the at least one partition comprises three partitions.

* * * * *